United States Patent [19]

Ingham et al.

[11] 4,358,053

[45] Nov. 9, 1982

[54] FLAME SPRAYING DEVICE WITH ROCKET ACCELERATION

[75] Inventors: Herbert S. Ingham, Northport; Ferdinand J. Dittrich, Massapequa, both of N.Y.

[73] Assignee: Metco, Inc., Westbury, N.Y.

[21] Appl. No.: 210,448

[22] Filed: Nov. 26, 1980

[51] Int. Cl.[3] ..... B05B 7/20

[52] U.S. Cl. ..... 239/79; 239/132.3

[58] Field of Search ..... 239/79–85, 239/132.3

[56] References Cited

U.S. PATENT DOCUMENTS 4,192,460 3/1980 Matsuo ..... 239/85 X

FOREIGN PATENT DOCUMENTS 1111995 7/1961 Fed. Rep. of Germany ..... 239/79
1150856 6/1963 Fed. Rep. of Germany ..... 239/79
859917 1/1941 France ..... 239/79
569330 8/1977 U.S.S.R. ..... 239/79

*Primary Examiner*—Andres Kashnikow
*Attorney, Agent, or Firm*—S. A. Giarratana; E. T. Grimes; J. D. Crane

[57] ABSTRACT

A flame spraying device including a rocket accelerator wherein a low velocity flame is produced into which a coating material is introduced. At least one rocket accelerator producing a high velocity stream of combustion product gases is positioned relative to the low velocity flame so that the coating material carried thereby is accelerated toward the substrate to be coated. By positioning the rocket relative to the low velocity flame, the dwell time in the low velocity flame can be optimized to produce the best coating of a substrate. The coating quality is also enhanced by the fact that the coating material does not oxidize or cool significantly while in the high velocity stream and by the fact that the coating material strikes the substrate at high speed thereby resulting in high density coating.

1 Claim, 6 Drawing Figures

FLAME SPRAYING DEVICE WITH ROCKET ACCELERATION

BACKGROUND OF THE INVENTION

The present invention relates broadly to devices for coating substrates and particularly to a device well suited for flame spraying various coating materials onto a substrate.

In the field of coating substrates, many different coating materials and devices for applying the material to a substrate have been developed. One such device is a flame spray gun which has a means for introducing a coating material, for example a powder, into a flame which then melts the coating material. The melted material is then carried by the flame to the substrate and adheres thereto. During the dwell time, i.e., the time during which the coating material is in the flame, the coating material is raised to an elevated temperature by the flame. At this elevated temperature, the coating material becomes molten so when it strikes the substrate it will adhere and cool thereon to form a layer of the coating material on the substrate.

In a combustion flame spray gun, the heating zone occurs within a combustion flame of a fuel such as acetylene, propane, natural gas or the like, with oxygen or air as the oxidizing agent. In a plasma flame spray gun, the heat is supplied by an electric arc flame and preferably by a free plasma flame, which issues from a nozzle after being heated by a high intensity electric arc.

In typical flame spray equipment, the coating material dwell time must be sufficiently long to achieve melting of the coating material so it will flow and adhere upon striking the substrate. Melting herein includes at least heat softening the surface of the particles of coating material. For most flame spray guns, because of the dwell time in the flame the coating material has a tendency to oxidize while in the flame. As a result of oxidation, the quality of the coating on the substrate achieved by such flame spray guns is not as high as may be desired.

It is known that higher velocity flames will propel the material at a faster rate, reducing the dwell time and, therefore, the degree of oxidation. Also, the higher velocity will cause the particles to flatten better at the substrate and to fill voids during buildup of the coating, resulting in coatings of higher density and quality. Plasma flame spray guns can provide higher velocity flames for producing coatings of high quality and low oxide content.

However, it is difficult to inject powdered flame spray materials uniformly into a high velocity flame and thus there are low heating efficiencies that cause low deposit efficiencies and erratic coating results. For example, some of the powder is accelerated along the cooler fringe of the high velocity flame and is heated insufficiently. Also, because of the short dwell time very high electric arc power is required for the plasma flame to heat the powder during the short dwell time, causing further problems with arc erosion of the internal components of the plasma gun, adding to maintenance time and expense.

Sometimes jets of high pressure air or inert gas are used to accelerate powder particles from a flame spray gun. However, these jets tend to cool the particles resulting in partially or completely solidifying the previously melted coating particles causing low deposit efficiency.

Accordingly, it is a primary object of the present invention to provide a flame spraying device which operates in a manner to minimize the oxidation of the coating material prior to its contacting the substrate.

It is a further object of the present invention to provide a flame spraying device which minimizes oxidation of the coating material while creating a denser and higher quality coating on the substrate.

Still further, it is an object of the present invention to provide a flame spraying gun with a higher deposit efficiency than can be achieved through conventional techniques.

The above objects of the invention are achieved by modifying a conventional flame spraying device by adding a means to accelerate the molten coating material after it leaves the flame spray gun so as to thereafter increase velocity and reduce the dwell time. The accelerator may take several forms each of which employs a combustion rocket with the gaseous products of combustion directed generally toward the path followed by the coating material as it travels from the flame spray gun to the substrate. In one form, the accelerator comprises two or more discrete rockets disposed around the spray nozzle and designed to aim the combustion product gases thereof generally toward though preferably at an acute angle or parallel to the path followed by the coating material. In another form, the accelerator rocket has an annular orifice disposed around the flame spraying gun nozzle and designed to direct combustion gases in a direction either parallel or at an acute angle to the direction of the molten coating material after it leaves the flame spraying nozzle. In some instances such as for coating the inside bore of a pipe the rocket may be approximately perpendicular to the flame of the flame spray gun.

The rocket accelerator(s) provide a high velocity hot gas stream which accelerates the molten coating material toward the substrate. Thus, by reason of acceleration, the dwell time is reduced. By reason of the lower dwell time, oxidation of the coating material is reduced. As the coating material is accelerated by a high velocity hot gas stream, the coating material does not cool excessively in transit between the gun nozzle and the substrate and the coating material strikes the substrate at a higher velocity than is achieved by a conventional flame spray gun. Both of these invention attributes contribute to a denser and higher quality coating being deposited on the substrate.

The foregoing and other objects, advantages and features of the invention are described below in greater detail in connection with the drawings which form a part of the disclosure, wherein.

DETAILED DESCRIPTION

Figure 1:
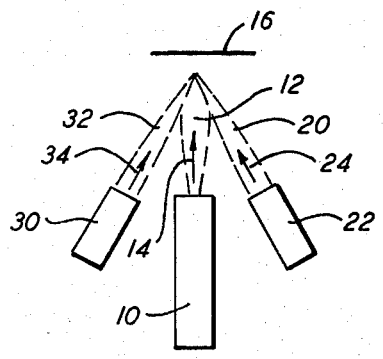
FIG. 1 illustrates in general terms the broadest concept of the present invention.

The broadest concept of the present invention is illustrated in FIG. 1 which includes a conventional flame spraying device 10 which produces a combustion flame 12 which moves at a relatively low velocity in the direction indicated generally by the arrow 14. The flame spraying device may be a low velocity plasma flame spray gun but is preferably a conventional powder combustion flame spray gun. The flame has a coating material introduced therein and is directed toward a substrate 16 and, in a manner well known in the art, the coating material impinges on the surface of the substrate 16 and bonds thereto to form a layer of the coating material. As has already been mentioned, the coating material is carried in the flame 12 for a period of time known as the dwell time. The longer the dwell time, the higher the oxidation of the coating material which is generally considered to be undesirable.

In an effort to provide sufficient heating but reduce the total dwell time, the present invention contemplates using combustion rockets directed in a direction generally to accelerate the coating material as it travels from the flame spraying gun 10 to the substrate 16. The term "generally to accelerate the coating material", as that term is used herein and in the claims, means that the direction of the high velocity stream of high temperature gas 20 is such that the high velocity stream 20 will interact with the low velocity stream 12 in a way which accelerates the coating particles carried in the low velocity stream 12 toward the substrate 16. It will be evident from this definition, therefore, that when the direction 24 is parallel to direction 14, the high velocity stream gas 20 must be sufficiently close to the low velocity stream 12 carrying the coating material so as to interact therewith and serve to accelerate the coating material carried by the low velocity stream 12.

In the normal use of a flame spraying gun 10, the operator generally points it toward the area on the substrate 16 that is to be coated. If a single rocket 22 were associated with the flame spraying gun 10, the high speed gas stream 20 of the rocket 22 would serve to change the direction of flight of coating material carried by the low velocity combustion product gases so that the region of the substrate that is coated will be somewhat different from the area at which the gun 10 is aimed. Accordingly, it is useful in many applications of the present invention to balance the arrangement so that the gun 10 can be aimed at the portion of the substrate 16 that is to be coated. This is accomplished in the illustrated embodiment by providing a second rocket 30 which produces a second high velocity stream of high temperature gas 32 which is directed in a direction indicated by the arrow 34. The rocket 30 is preferably disposed symmetrically with respect to the flame spraying gun 10 and the rocket 22 so that the area of the substrate 16 that is coated by the apparatus is located in a direction which corresponds to the direction in which the gun 10 is aimed. Those skilled in the art will recognize the same result may be achieved by symmetrically locating a plurality of accelerator rockets as well.

Figure 2:
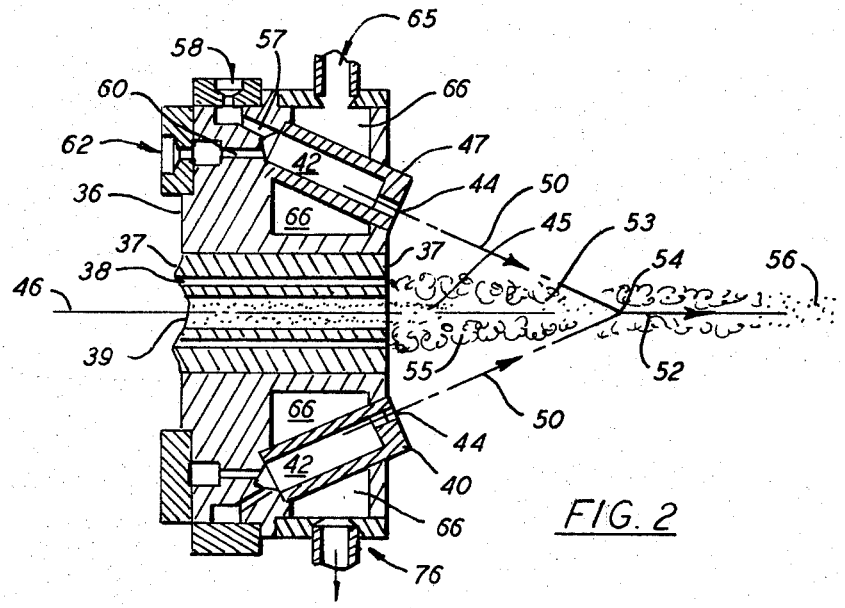
FIG. 2 illustrates, in cross-section, a rocket attachment to a conventional flame spray gun nozzle.

Referring now to FIG. 2, an assembly is shown in cross-section which may comprise an attachment to a typical flame spraying gun, the output nozzle of which is indicated at 37. The nozzle 37 includes a centrally located aperture 39 through which exits a stream of carrier gas containing coating particles indicated at 45.

A mixture of a fuel gas such as acetylene, propane, natural gas or the like with oxygen or air is injected from the body of the flame spray gun (not shown) through a plurality of orifices 38 equally spaced in a circle about the central axis 46. Combustion occurs in the zone 55 forward from the gun, and the combustion gas flame entrains the powder particles 45 and heats them in zone 53 while propelling them at low velocity, toward the right in FIG. 2.

The cross-section of the attachment illustrated in FIG. 2 is shaped to fit over the tip 37 and has a body 36 that fits over the nozzle 37.

Attached to the body 36 is a rocket assembly with an annular shaped combustion chamber 40 enclosing a combustion area 42 and having an annular exit passageway 44 through which pass the gaseous products of combustion produced in the combustion area 42. The gases exiting through the opening 44 are at a high velocity and travel in a direction indicated generally by the arrows 50. The direction of the high velocity combustion gases from the combustion chamber 40 is a function of the physical design for the combustion chamber 40 and the exit opening 44 in a manner which is well known to those skilled in the art of combustion rockets. The direction of these high velocity combustion product gases as illustrated by the arrows 50 are preferably arranged so that the high velocity gases will travel in a direction intersecting the arrow 52 at point 54 where the arrow 52 represents the direction of the low velocity gases coming from the conventional flame spraying gun having tip 37. The angle between the arrow 50 and the arrow 52 is preferably small and approximately 20° although angles of 0° to greater than 30° with proper proportioning of the components are satisfactory. Since the high velocity gases will interact with the low velocity gases 53, the high velocity gases will serve to accelerate the low velocity gases and any particles of coating material contained therein. The rocket accelerator may, for example, double the velocity of the coating material particles carried by the low velocity gases.

The combustion area 42 is coupled by a passage 57 to an inlet passageway indicated generally at 58 for introducing an oxidizer such as oxygen or air. The combustion area 42 is also coupled by a passageway 60 to an inlet opening 62 which is designed to receive a combustible gas or liquid such as acetylene, propane, natural gas or kerosene. The combustible gas and the oxidizer, when introducing into the combustion area 42, will maintain combustion in the area 42 thereby permitting gases of the combustion products to be formed which exit through the opening 44 at a high velocity.

By reason of the fact that a great deal of heat is generated within the combustion area 42, the apparatus of FIG. 2 additionally includes a cooling chamber 66 which has a coupling indicated generally at 65 for receiving a cooling liquid such as water from an external coolant reservoir and pump (not shown). The coolant exits the chamber 66 through a coupling indicated generally at 76 and is either disposed of or returned to the reservoir.

Figure 3:
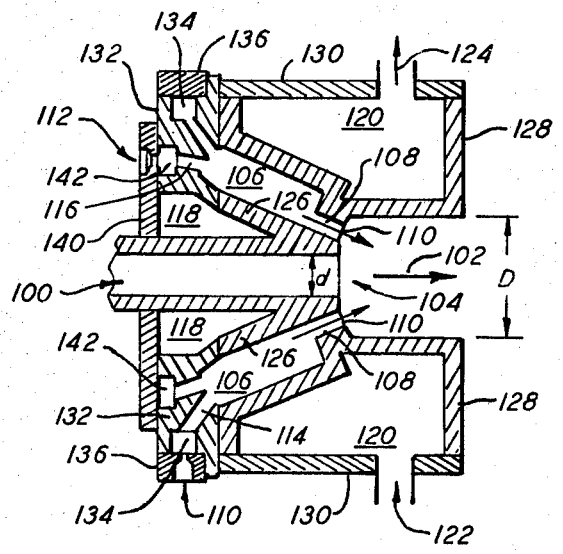
FIG. 3 illustrates, in cross-section, an alternative rocket attachment for a conventional flame spray gun.

FIG. 3 illustrates in cross-section another embodiment of the present invention wherein there is a cooling chamber shroud surrounding the zone of high velocity gases issuing from the rocket assembly. In this embodiment, a centrally located bore 100 is provided for directing the combustion product gases and entrained powder particles from a conventional flame spraying device in a direction as indicated generally by the arrow 102. When the device is utilized for flame spraying, the combustion product gases traveling in the direction 102 will carry heated coating particles which are projected toward a substrate (not shown).

At the forwardmost end 104 of the central bore 100 is an opening having a diameter as indicated by the double headed arrow labelled d. A conventional flame spray gun nozzle (not shown) is in the central bore 100, traveling to the right from the forwardmost end 104, the assembly expands in diameter until it reaches a new diameter of D which is greater than the diameter d.

The assembly in FIG. 3 has an annular combustion chamber 106 which is formed of various walls and openings and is disposed radially outward of the central bore 100. The combustion chamber has an annular opening 108 which communicates with the portion of the assembly having a diameter of D. The annular opening is disposed so that combustion product gases formed in the combustion chamber 106 will exit therethrough in a direction indicated generally by the arrow 110. The gases from the combustion chamber 106 co-act with the combustion gases and entrained powder particles traveling in the direction 102.

The combustion chamber 106 has an inlet 110 adapted to receive a combustible gas and a second inlet 112 adaptable to receive an oxidizer. The gases received through inlet 110 pass through a passageway 114 into the combustion chamber 106 while the oxidizer flows through a passageway 116 into the combustion chamber 106. The oxidizer and the combustible gas are ignited in the combustion chamber 106 and the combustion product gases therefrom exit through the annular opening 108. When the rate of combustion is sufficiently high, the velocity of the gases exiting through the annular opening 108 have a sufficient velocity to accelerate the gases and the entrained coating particles traveling in the direction 102.

Due to the heat produced in the combustion chamber 106 and the heat of the combustion product gases traveling down the bore 100, cooling is necessary in order to prevent the assembly shown in FIG. 3 from melting. Cooling is provided by two cooling chambers 118 and 120. Cooling chamber 120 has an inlet 122 for receiving a coolant such as water and an outlet 124 permitting the coolant to exit therefrom so that it can pass through, if necessary, a heat exchanger and then back into the cooling chamber again. A similar arrangement (not shown) is provided for the chamber 118 or, the chamber 118 may be designed with passages that communicate with chamber 120.

The assembly according to FIG. 3 is comprised of a number of elements which are typically formed by casting or other suitable means of manufacture. One wall 126 of the combustion chamber 106 is formed integrally with the wall surrouding bore 100. In spaced relationship therewith is a burner body 128 which, among other things, forms the other wall of the combustion chamber 106 and the portion of the assembly discussed earlier having a diameter D. The body 128 also forms the radially outward portion of the annular opening 108. Disposed in contact with and radially outward of the burner body 128 is a cooling chamber shroud 130 which forms, with the burner body 128, the cooling chamber 120. To the left of the assembly as viewed in FIG. 3, an annular gas distribution member 132 is provided with the manifold chambers 134 and 142 found therein to distribute around the assembly the combustible gas and the oxidizer which are used in the combustion chamber 106. Disposed radially outward of the body 132 and blocking the passage for the combustible gases 134 is a gas manifold shroud 136 which, in its operative position as shown, prevents the combustible gas from escaping from the chamber 134. In a similar fashion, an oxidizer manifold shroud 140 closes the passageway 142. The oxidizer manifold shroud 140 also cooperates with the wall of the central bore 100 and a portion of the body 132 to form the cooling chamber 118.

Figure 4:
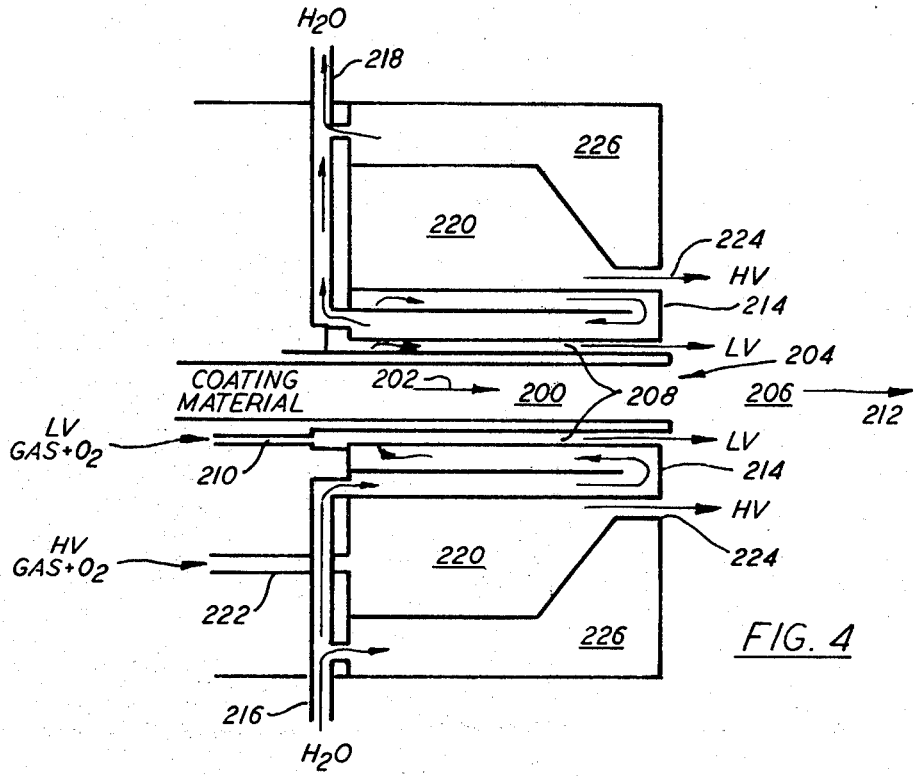
FIG. 4 illustrates, in cross-section, a flame spraying gun with an integral rocket accelerator.

FIG. 4 is a cross-sectional view of an alternative arrangement according to the present invention wherein the rocket accelerator is disposed radially outward of a flame spray gun and provides an annular high velocity sheath of high temperature gas parallel to the direction of the flame spray stream. The arrangement includes a centrally located passageway 200 through which a coating material is forced in a direction of the arrow 202 so that the coating material, as it exits through the forwardmost opening 204 of the passage 200, is introduced into a flame which is formed in the region indicated at 206. The flame at 206 is produced from the burning of a combustible gas mixture in this region where the combustible gas mixture is delivered by way of an annular passage which is disposed radially outward of the central passage 200. The combustible gases are introduced into the annular passage 208 by a coupling tube 210 which is connected to a supply of combustible gas, such as propane mixed with oxygen gas. These gases further mix together in the coupling tube 210 and the annular passage 208 so that when these gases exit into the region 206 they are mixed in proper proportion to form a hot flame. Then, as the coating material is introduced into the flame in the region of 206, the coating material will melt and molten particles thereof will be carried by the flame generally in the direction of 212.

Disposed radially outward of the annular gas delivery passage 208 is a cooling jacket 214 into which a coolant, such as water, is introduced from a delivery tube 216. Also coupled to the cooling jacket 214 is an outflow tube 218 so that the coolant introduced into the jacket will flow therethrough and then return via the outflow tube 218 to a coolant reservoir (not shown) where the heat can be dissipated.

Disposed radially outward of the cooling jacket 214 is a rocket combustion chamber 220 which receives from a gas inlet tube 222 a mixture of combustible gas and an oxidizer gas. The mixture is ignited in the combustion chamber 220 to produce combustion product gases which exit from the combustion chamber 220 through an annular nozzle opening 224. The combustion product gases exiting through the opening 224 travel in a direction indicated generally by the arrow HV and, by reason of the construction of the combustion chamber 220, these gases travel at a relatively high velocity compared to the velocity of the flame in the region 206. Since the high velocity gases surround the flame produced radially inward thereof and are in close proximity thereto, the high velocity gases will coact with the low velocity gases thereby accelerating the flame gases and particles carried thereby.

The assembly according to FIG. 4 further includes a second cooling jacket 226 which is coupled to the tubes 216 and 218 so that the coolant traveling in these tubes 216 and 218 can be diverted through the cooling jacket 226. Because the cooling jacket 226 is located radially outwardly of the combustion chamber 220 and the opening 224, the coolant in the cooling jacket 226 serves to keep the temperature in the walls of the combustion chamber 220 from rising too high.

Figure 5:
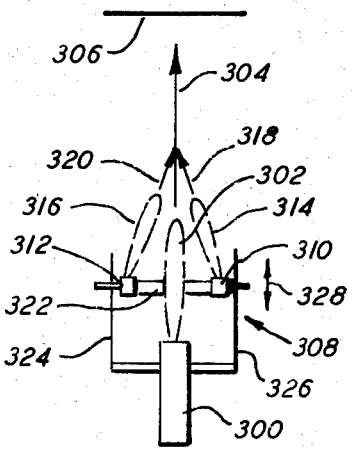
FIG. 5 illustrates an embodiment where the rockets are located closer to the substrate than the flame spray gun.

FIG. 5 illustrates a further alternative embodiment of the present invention. In this arrangement, a conventional flame spray gun is provided at 300. This gun produces a flame which is illustrated generally at 302 into which a coating material is introduced in a conventional manner. The flame spray gun 300 produces a flame as well as melted coating particles which are projected thereby in a direction indicated generally by the arrow 304. In the event a substrate 306 is located along the path of travel 304, the molten particles of coating material carried by the flame from the gun 300 will strike and adhere to the substrate 306.

Located between the substrate 306 and the flame spray gun 300 is a rocket accelerator assembly indicated generally at 308. This assembly 308 may take the form generally of the type described earlier, however, for illustrative purposes, the arrangement of FIG. 5 includes two rocket combustion chambers 310 and 312 respectively producing high temperature, high velocity gas jets 314 and 316 which are directed generally toward the substrate 306 as indicated by arrows 318 and 320. The direction arrows 318 and 320 intersect the direction arrow 304 and an acute angle is formed between each of these arrows. An approximately optimum angle between arrows 320, 318 and arrow 302 is approximately 20°. By adjusting the position of the rockets 310 and 312 with respect to the direction arrow 304, the direction of the gas jets 314 and 316 can be varied with respect to the direction arrow 304 so that the angle between the direction arrow 318 and 320 can be varied to other angles which, by experiment, may prove to be more optimal for the particular material which is being flame sprayed onto the substrate 306.

As illustrated in FIG. 5, the rockets 310 and 312 are coupled together by a coupling body 322 which may comprise a semi-annular ring or other suitable coupling which is rigidly connected to the rockets 310 and 312 and still permits the flame 302 to unobstructedly pass between the rockets 310 and 312.

The rockets 310 and 312 and the coupling body 322 comprise an assembly which is slideably mounted on two rails 324 and 326 thereby permitting the assembly to be moved in two directions as indicated by the double-headed arrow 328. In this manner, the rockets 310 and 312 can be adjustably positioned with respect to the nozzle of the flame spray gun 300. Accordingly, the dwell time in the flame 302 prior to experiencing accelerating forces due to the rockets 310 and 312 can be adjusted by adjusting the position along the rails 324 and 326 of the rockets 310 and 312. Experimentation indicates that the distance along the direction arrow 304 between the nozzle of the spray gun 300 and the nozzle of the rockets 310 and 312 have produced excellent coatings for some coating materials on the substrate 306 when the internozzle distance is in the order of 4 inches. Experimentation is necessary, with particular coating materials, to determine the most optimum distance between the nozzle of the spray gun 300 and the nozzle of the rockets 310 and 312.

As indicated above with respect to FIG. 5, two discrete rockets may be employed in the assembly thereshown to accelerate the flame gases and the coating particles carried therein toward the substrate 306. As will be evident from the earlier discussion, the rockets 310 and 312 may be replaced by an assembly having an annular rocket assembly with an annular nozzle to produce a substantially annular flame which surrounds the flame 302. It will also be recognized that a plurality of rockets may be placed symmetrically around the flame 302 thereby achieving substantially the same result.

Figure 6:
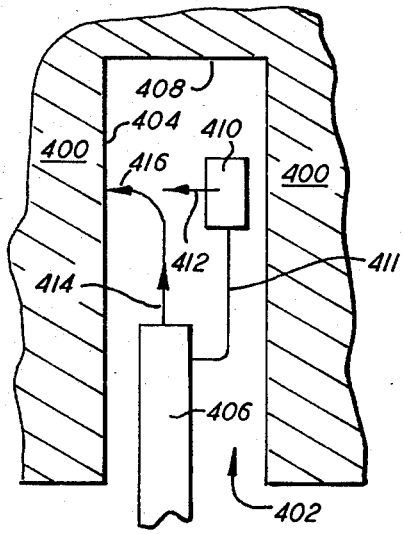
FIG. 6 illustrates schematically a further embodiment of the invention where the rocket accelerator is directed generally in a direction perpendicular to the flame from a flame spray gun.

Referring to FIG. 6, a substrate 400 with a deep hole indicated generally at 402 which has a side wall 404 which is desired to be coated using a conventional flame spray gun 406. Because a conventional flame spray gun 406 propels the coating material in a straight line, a conventional flame spray gun 406 can be used to coat the bottom wall 408 of the hole 402 because the gun can be aimed thereat. However, the flame spray gun 406 cannot be aimed directly at the side 404 so the coating that can be deposited thereon is likely to be of poor quality.

To improve this situation, a rocket accelerator 410 of the type described earlier is provided. The rocket accelerator 410 is preferably adjustably mounted on a support member 411 so that the position and direction of the gas jet, indicated generally by the arrow 412, can be adjusted. As illustrated, when the gas jet 412 from the rocket 410 is directed perpendicular to the direction 414 of the flame leaving the flame spray gun 406, the rocket 410 will cause the flame and the coating material carried thereby to change direction as illustrated at 416 and to travel toward the side wall 404. Accordingly, the arrangement of FIG. 6 will allow a conventional flame spray gun to be used for coating side walls of deep holes, bores, tubes and the like where such was not previously advisable.

While the foregoing description has emphasized alternative embodiments encompassing the present invention, it will be readily recognized by those of ordinary skill in the art that various modifications to the structures described may be made without departing from the spirit and scope of the invention as defined in the following claims.

What is claimed is:

1. A flame spraying device comprising, in combination:

a coating material delivery tube with an exit orifice out of which a coating material can be ejected;

a plurality of combustible gas delivery tubes surrounding said coating material delivery tube each providing a passage for combustible gases, said combustible gas delivery tubes having exit orifices disposed proximate said material delivery tube exit orifice so that on combustion of the combustible gas, the coating material ejected from said coating material delivery tube enters a low velocity flame causing the coating material to be elevated in temperature;

a first cooling chamber surrounding said combustible gas delivery tubes for circulating a coolant and reducing the temperature of said flame spraying device;

a rocket chamber disposed around said first cooling chamber for burning a combustible gas therein and producing a high velocity stream of combustion product gases through an annular exit nozzle disposed proximate said exit orifice of said gas delivery tube so that said high velocity stream will accelerate the particles in said low velocity flame; and second cooling chamber surrounding said rocket chamber to reduce the temperature of said rocket chamber.

* * * * *